US007237743B2

(12) United States Patent
Czechowicz et al.

(10) Patent No.: US 7,237,743 B2
(45) Date of Patent: Jul. 3, 2007

(54) SHEET WINDUP STARTER

(75) Inventors: Dennis S. Czechowicz, Appleton, WI (US); Richard M. Strebel, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 192 days.

(21) Appl. No.: 10/892,817

(22) Filed: Jul. 16, 2004

(65) Prior Publication Data

US 2006/0011768 A1 Jan. 19, 2006

(51) Int. Cl.
*B65H 35/08* (2006.01)

(52) U.S. Cl. ..... 242/527; 242/527.2; 242/527.3; 242/532.2

(58) Field of Classification Search ..... 242/527.3, 242/527.2, 527, 532.2, 532.3
See application file for complete search history.

(56) References Cited

U.S. PATENT DOCUMENTS 3,501,104 A * 3/1970 Hellemans ..... 242/527.4
4,445,646 A 5/1984 Karr et al.
4,484,714 A * 11/1984 Puzey ..... 242/527.3
4,546,930 A 10/1985 Rohde et al.
4,695,004 A 9/1987 Grossmann et al.
4,798,350 A 1/1989 Jorgensen et al.
5,360,179 A 11/1994 Vesterinen et al.
5,377,930 A 1/1995 Noyes
5,505,403 A * 4/1996 Raudaskoski ..... 242/527.3
5,584,445 A 12/1996 Kremar
5,820,065 A 10/1998 Altosaar et al.
6,273,356 B1 * 8/2001 Burton ..... 242/527.3
6,332,587 B1 12/2001 Moller et al.
6,379,502 B1 4/2002 Satzger et al.
6,427,938 B1 8/2002 Madrzak et al.
6,474,589 B1 11/2002 Enwald et al.
6,581,868 B1 6/2003 Enwald et al.
6,752,348 B2 6/2004 Dreckmann et al.
2004/0144879 A1 * 7/2004 Acciari ..... 242/527.3

* cited by examiner

*Primary Examiner*—William A. Rivera
*Assistant Examiner*—Sang Kim
(74) *Attorney, Agent, or Firm*—Stiennon & Stiennon

(57) ABSTRACT

A tail turn-up assembly has a frame positioned upstream of a reel spool. A carriage is pivotally mounted to the frame by a four bar linkage. The carriage is pivotable, from a retracted position to an extended position. When the carriage is engaged with the reel spool, a pair of curved tracks are positioned so that arcs defined by the tracks have their centers coincident with the spool axis. A knife carriage rides on the curved tracks and is constrained to move circumferentially about the reel spool. An actuator on the carriage causes the knife carriage to traverse circumferentially about the reel spool. The knife carriage has a leading edge formed by a knife which tears through the a tail which is cut from the web when the knife carriage is moved on the curved tracks.

19 Claims, 4 Drawing Sheets

SHEET WINDUP STARTER

CROSS REFERENCE TO RELATED APPLICATIONS

Not applicable.

STATEMENT AS TO RIGHTS TO INVENTIONS MADE UNDER FEDERALLY SPONSORED RESEARCH AD DEVELOPMENT

Not applicable.

BACKGROUND OF THE INVENTION

The present invention relates to windups in general and to automatic reel change in a windup in particular.

A windup is used with a calender or other paper handling equipment. Paper is unwound and passed through a calender, coater or other paper handling equipment and wound on to empty spools. In a process such as calendering, it is most cost effective if the winding of paper onto the reels is as automatic as possible. Automation reduces labor, increases productivity of the machinery used, and increases safety.

After leaving the last lead-out roll in a calender or other paper converting equipment, the paper web is threaded through a rider roll assembly. The rider roll assembly typically includes a pivoting arm, a lead-in roll, and a rider roll. Auto splicing components and a traversing knife, as well as a nip guard may also be mounted to the pivoting arm. The rider roll engages a reel being formed about a spool which is held in a windup stand.

Stiff paper webs can present difficulties in reliably directing a paper tail around the new spool in a windup. This is particularly true if a nip guard requires the web to be threaded into a narrow gap between the nip guard and the new spool. What is needed is an automatic device which can thread a web of paper or other sheet material, particularly board or stiff paper, reliably and in the presence of a nip guard.

SUMMARY OF THE INVENTION

The windup stand of this invention has a tail turn-up assembly which can also be referred to as a sheet windup starter which effects the transference of a paper web from a machine spool to a new spool. A new reel spool is engaged with the web and turns at the same speed as a moving web. As the web continues past the new spool to a finished reel spool, a knife blade mounted on a knife carriage cuts a tail about 10 inches wide from the web. A a tail turn-up assembly is positioned upstream of the reel spool. The tail turn-up assembly has a frame and a carriage pivotally mounted by a four bar linkage to the frame. The frame is mounted to the machine floor below and upstream of the reel spool.

The carriage is pivoted from a retracted position to an extended position by a pneumatic actuator. The carriage has wheels mounted on either side of the carriage which, when the carriage is in the extended position, one wheel engages the web, and the other wheel engages only the reel spool. A plurality of wheels are resiliently mounted by springs to a knife carriage which rides on the carriage. These wheels also engage the web and the reel spool about which the web is wrapped.

When the carriage is in engagement with the reel spool, a pair of curved tracks are positioned so that the arcs defined by the tracks have their centers coincident with the spool axis. The knife carriage has cam followers which ride on the curved tracks. The cam followers and the curved tracks constrain the knife carriage to move circumferentially about the reel spool. A second pneumatic actuator on the carriage causes the knife carriage to traverse circumferentially about the reel spool as guided by the circumferential tracks. The knife carriage has a leading edge formed by a knife which tears through the 10 inch tail being cut from the web by the traversing knife.

The cut web tail is held against the reel spool by the spring-loaded wheels and air jets from an air blow pipe mounted on the knife carriage, and the driven reel spool continues to feed the tail into a nip with a rider roll positioned above the reel spool. A threading pan with an air blow directs the web tail into the nip formed with the rider roll, and a new reel begins to form on the reel spool. The traveling knife then moves in a cross machine direction, widening the tail until it encompasses the entire web.

It is a feature of the present invention to provide a windup with automatic threading which can reliably handle paper or board which is relatively stiff.

It is a further feature of the present invention to provide a tail turn-up assembly which can be moved into and out of a tail turnup position from beneath a reel spool.

It is another feature the present invention to provide a turn-up assembly which can reliably direct a paper web into a narrow slot formed between a nip guard and a reel spool.

Further features and advantages of the invention will be apparent from the following detailed description when taken in conjunction with the accompanying drawings.

DESCRIPTION OF THE PREFERRED EMBODIMENTS

Figure 1:
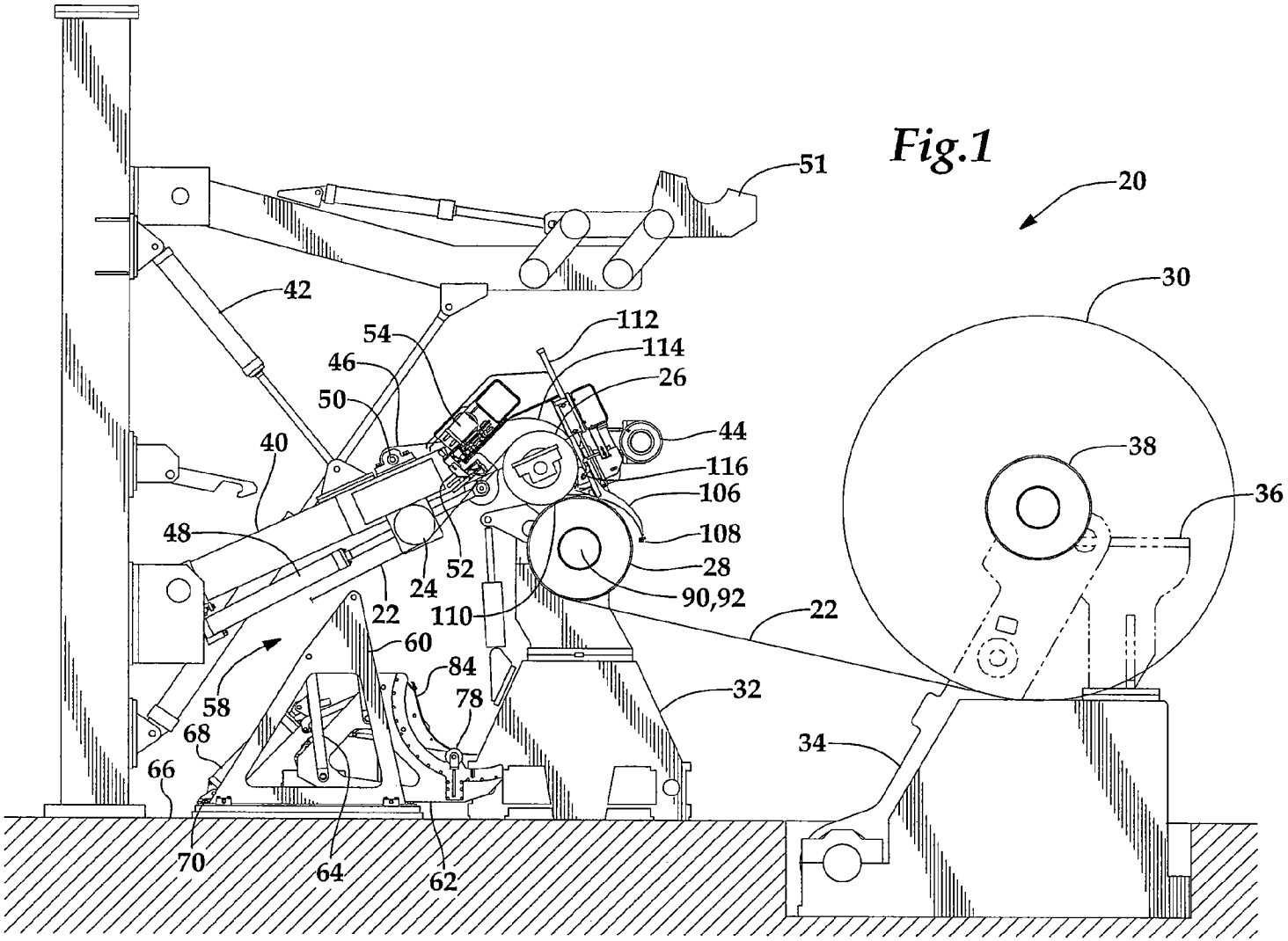
FIG. 1 is a side elevational cross-sectional view of a windup of this invention.

Referring more particularly to FIGS. 1–5, an apparatus 20 for forming and directing a web tail is shown in FIG. 1. A paper web 22 extends from a calender (not shown) and over a guide roll 24, then wraps around a rider roll 26 which engages a reel spool 28. From the reel spool 28 the web extends to a nearly complete reel 30. The reel 30 is driven by a center wind assist (not shown) and initially formed on a pair of windup stations 32 and the reel formation is controlled by the rider roll 26. Once the reel 30 is nearly complete, the speed of the web is reduced and the reel 30 is transferred from the windup stations 32 to the transfer arms 34, and is transferred by the pair of transfer arms 34 to a pair of rails 36. For clarity, FIG. 1 shows one half or one side of the roll handing equipment between which the reel spool 28 and reel 30 are handled.

A second center wind assist (not shown) mounted to one of a spaced apart pair of transfer arms 34 continues to drive the spool 38 about which the reel 30 is formed as it is transferred to and held on the rails 36. The rider roll 26 is mounted on rider roll arms 40. When the reel 30 is transferred by the transfer arms 34, the rider roll arms 40 are retracted by linear actuators 42. A guide roll 44 is mounted to guide arms 46. The guide roll 44 is retracted by a linear actuators 48 which pivot the guide arms 46 about pivots 50. A new reel spool 28 is loaded into the windup station 32 by overhead spool loading devices 51. With the rider arms 40 and guide arms 46 retracted, the web 22 is directed away from the windup station while the reel spool 28 is lowered on to the windup stations 32. The center wind assist (not shown) brings the reel spool 28 up to the speed of the moving web 22. The guide arms 46 are then extended raising the guide roll 44, then the rider roll 26 is lowered by extending rider roll arms 40 bringing the web 22 into engagement with the reel spool 28.

A tail turn-up assembly 58 has a frame 60 positioned upstream of the reel spool and windup stand 32. The turn-up assembly 58 has a leading edge knife 102 mounted on a knife carriage 84 which is mounted for motion on a pivoting carriage 62, which is pivotally mounted to the frame 60.

A knife blade 52 is mounted on a cross machine direction movable knife shuttle 54, which is positioned upstream of the rider roll 26. The knife blade 52 is positioned inwardly from the edge of the web, and when it is brought into engagement with the web the web is slit into two adjacent strips. When the new reel spool 28 is engaged with the web 22, as shown in FIG. 1, the knife blade 52 engages the web and slits the web into two parallel web strips: a narrow strip which will define the tail 56, and a wider strip composed of the remainder of the web. The tail 56 is about 10 inches wide on the tending side of the windup stand 32. The carriage 62, as best shown in FIGS. 2–5, is pivotally mounted by a four bar linkage 64 to the frame 60. The frame 60 is mounted to the machine floor 66 below and upstream of the reel spool 28.

Figure 2:
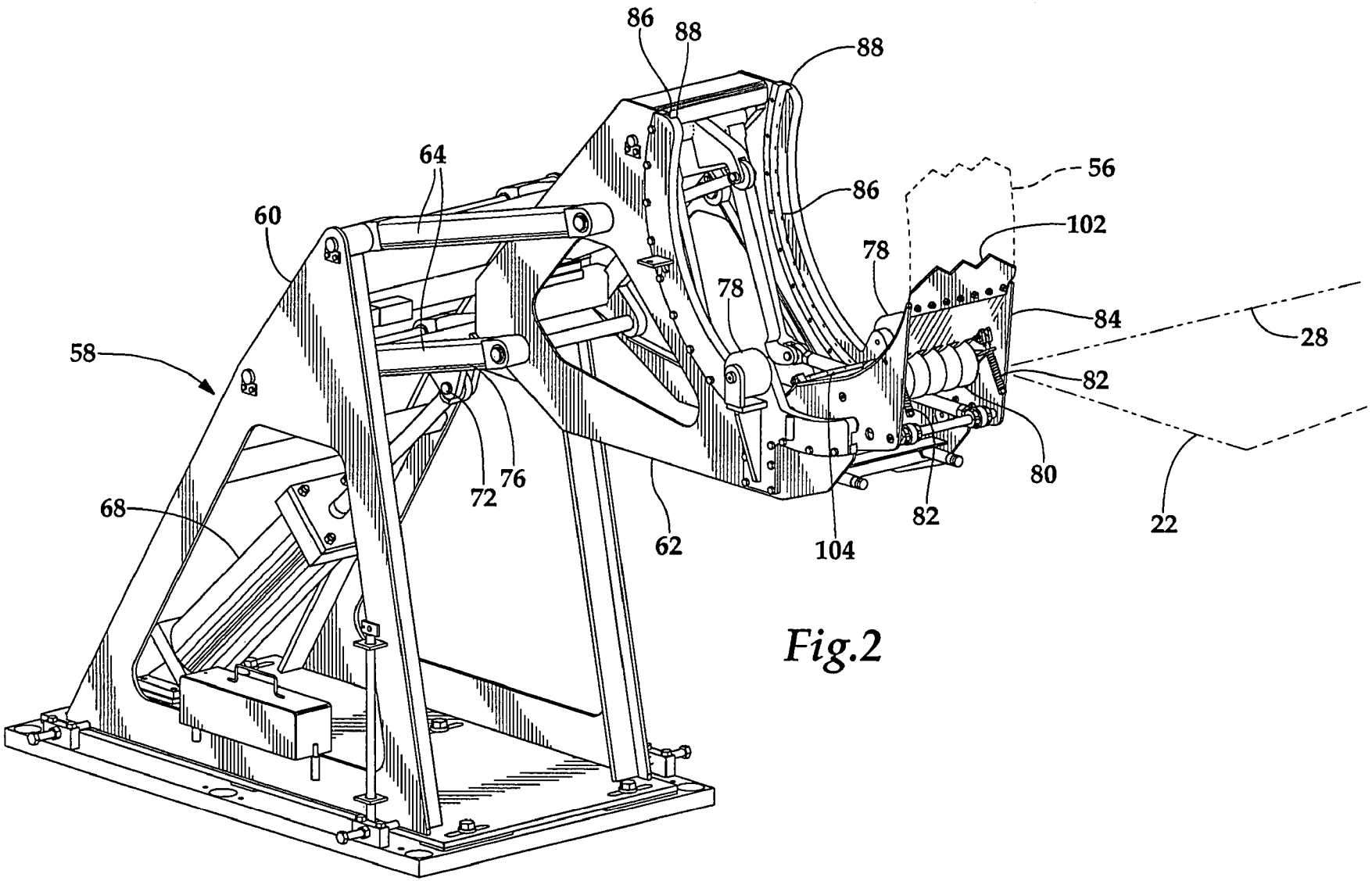
FIG. 2 is an isometric view of the tail turn-up assembly of the windup of FIG. 1.
Figure 3:
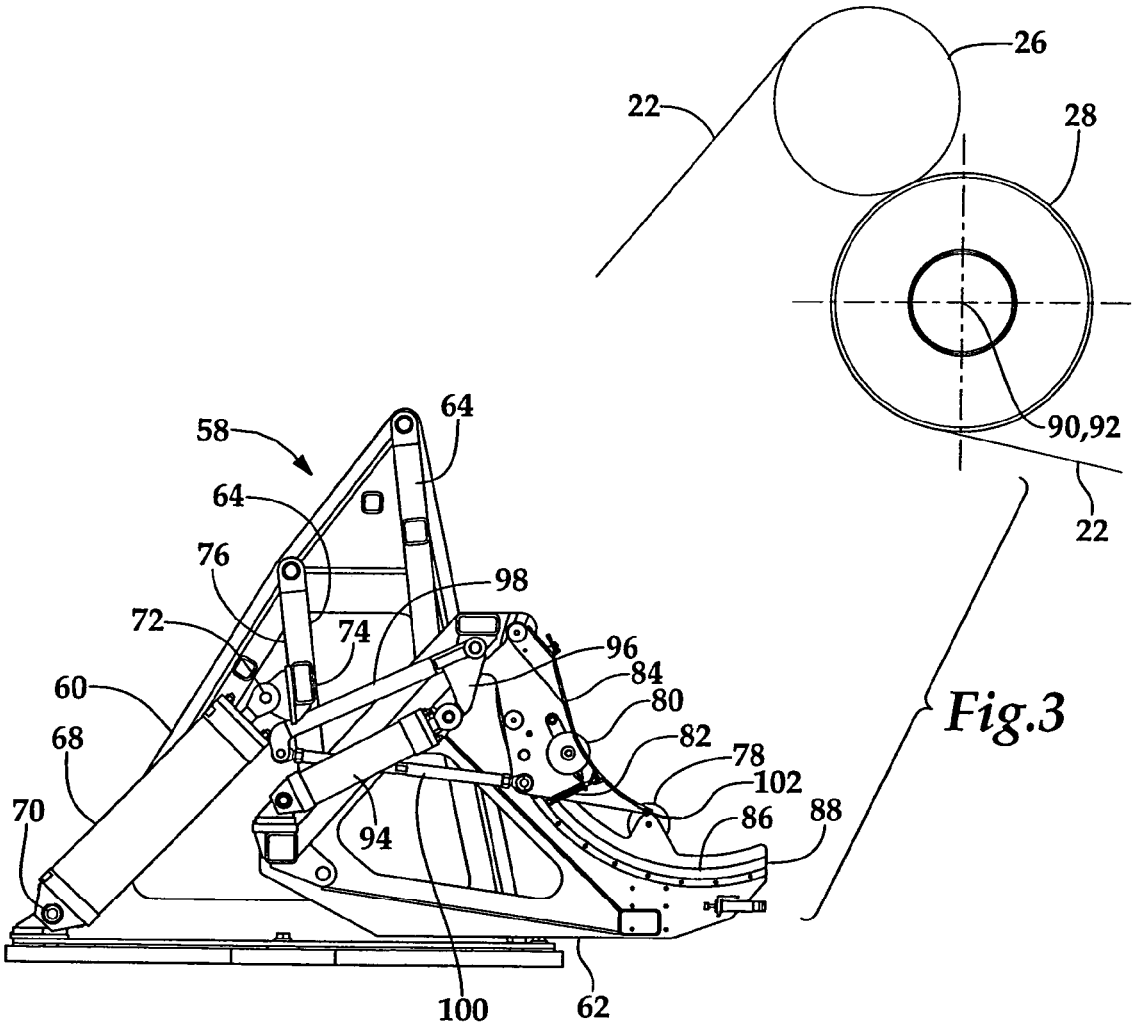
FIG. 3 is side elevational cross-sectional view of the turn-up assembly of FIG. 2 with the carriage spaced from the reel spool.
Figure 4:
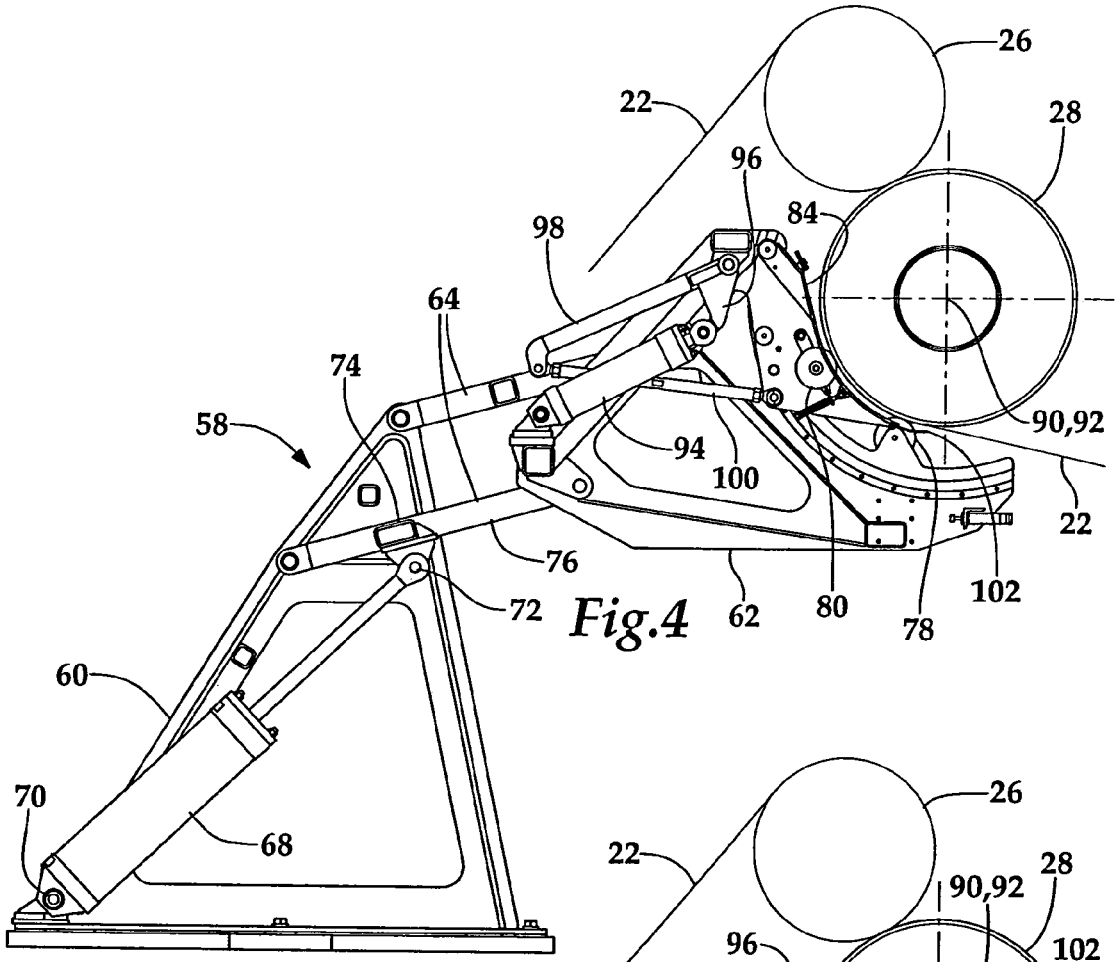
FIG. 4 is side elevational cross-sectional view of the turn-up assembly of FIG. 2 with the carriage positioned engaged with the reel spool.
Figure 5:
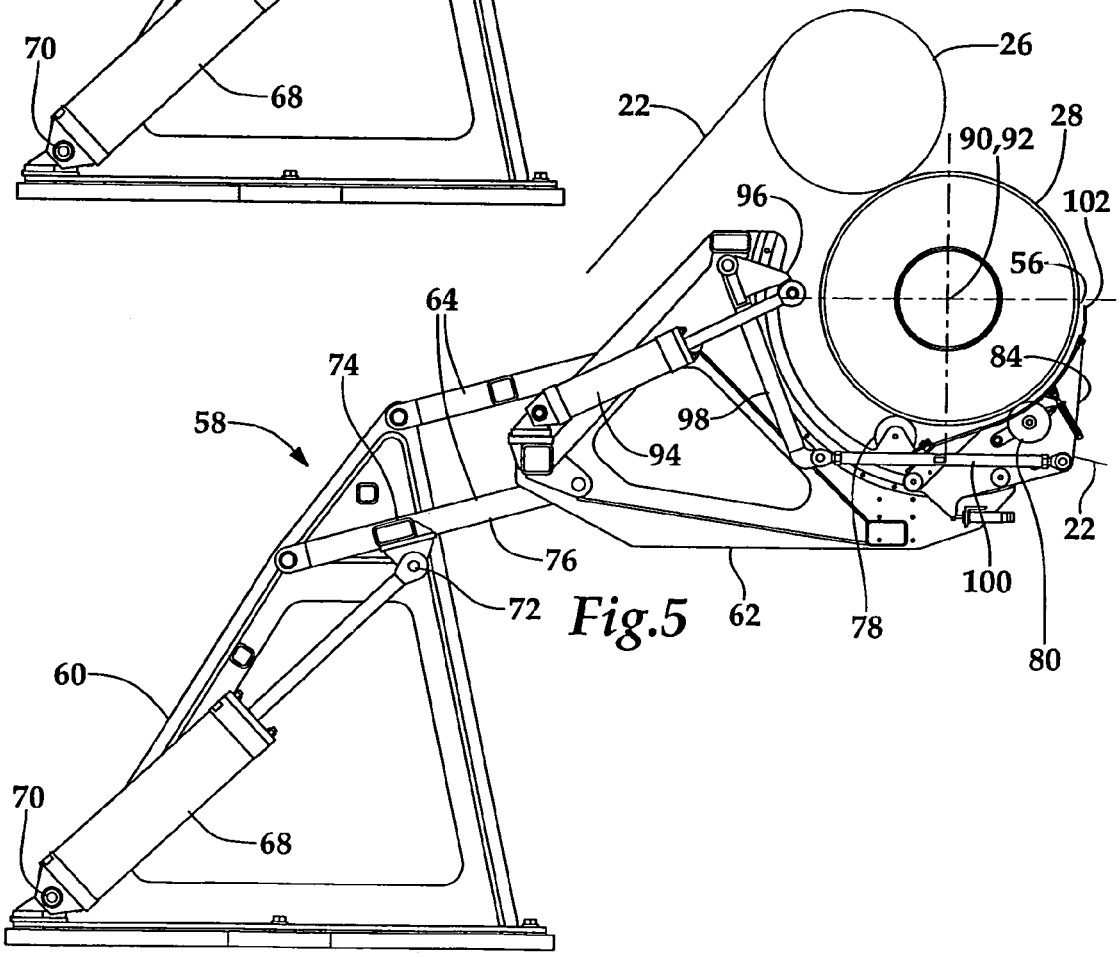
FIG. 5 is side elevational view of the turn-up assembly of FIG. 2 with the carriage positioned engaged with the reel spool and the knife carriage extended to sever a web tail.

To cut the tail 56 from the narrow strip of web, the carriage 62 is pivoted from a retracted position as shown in FIGS. 1 and 3, to an extended position, as shown in FIG. 4, in which the carriage engages the web against the roll 28. The knife carriage 84 then moves as described below to make a cross-machine direction cut which severs the narrow strip of web to define a tail 56 and allows the tail to be wrapped around the new spool. The carriage 62 is pivoted by a pneumatic actuator 68 which extends between a pivot point 70 on the frame 60 and a pivot point 72 mounted to a cross member 74 which connects the lower two linkage bars 76 of the four bar linkage 64 as shown in FIGS. 3–5. As shown in FIGS. 2, 4 and 5, the carriage 62 has wheels 78 mounted on either side, one of which engages the web 22 and the other of which bears against the reel spool 28. In addition, a plurality of wheels 80 are resiliently mounted by springs 82 to the knife carriage 84 on the pivoting carriage 62. The wheels 80 also engage the web 22 and the reel spool 28 about which the web is wrapped. More particularly, the wheels 80 engage that portion of the web which forms the cut tail.

When the carriage 62 is positioned in engagement with the reel spool 28, a pair of curved tracks 86 formed by opposed grooves 88 are positioned so that the arcs defined by the tracks 86 has their centers 90 coincident with a spool axis 92. The knife carriage 84 has cam following wheels (not shown) which ride in the grooves 88 forming the curved tracks 86.

The cam following wheels and the curved tracks 86 constrain the knife carriage 84 to move circumferentially about the reel spool axis as shown in FIG. 5. A second pneumatic actuator 94 is mounted to the carriage 62 and extends to a short arm 96 on a pivotally mounted first member 98 which in turn is pivotally connected to a second member 100, which in turn is connected to the knife carriage 84. Extension of the second pneumatic actuator 94 causes the knife carriage 84 to traverse circumferentially about the reel spool 28 as guided by the circumferential tracks 86. The movement of the knife carriage 84 is shown between FIG. 4 and FIG. 5. The knife carriage 84 has a leading edge knife 102 which tears through the narrow strip to sever the 10-inch tail 56 from the narrow web strip which is being cut from the web 22 by the traversing knife 52.

The cut web tail 56 is held against the reel spool 28 by the spring-loaded wheels 80 and an air blow pipe 104, as the driven reel spool 28 continues to feed the tail 56 into the nip 110 formed between the rider roll 26 and the reel spool 28. A threading pan 106, shown in FIG. 1, has an air blow 108 at its lowermost point, which directs the web tail 56 into the nip 110, and a new reel begins to form on the reel spool 28. Once the tail is successfully threaded, the traversing knife 52 mounted to the knife shuttle 54, which had remained fixed during the threading operation, then traverses the web in the cross machine direction widening the tail 56 until it encompasses the entire web 22. The threading pan 106 is mounted to a pneumatic actuator 112 which retracks the threading pan 106 after the successful threading of the tail. A stationary threading pan 114 extends over the rider roll 26 for directing the tail about the rider roll, functions only in the initial manual turn-up. A water-shower 116 is positioned to spray water on to the reel spool to assist the tail adherence to the reel spool 28. A water spray is typically used with heavier grades of paper or board. A low volume of water creates an air shower directed at the tending side edge of the rider roll and spool nip 110. The water shower is arranged to be turned on automatically as soon as the tail knife 102 cuts the tail 56.

Following completion of the reel spool change, the pneumatic actuators 68 and 94 are retracted and the carriage 62 and knife carriage 84 are returned to their original positions as illustrated in FIG. 1.

It should be understood that the wheels 78 of the carriage 62 for purposes of the claims engage the spool 28 when they engage the web 22 against the spool 28.

It is understood that the invention is not limited to the particular construction and arrangement of parts herein illustrated and described, but embraces all such modified forms thereof as come within the scope of the following claims.

What is claimed is:

1. An apparatus for forming and directing a web tail comprising:

a windup stand;

a spool mounted to the windup stand, the spool defining an axis;

a frame mounted upstream of the spool and separate from the windup stand;

a unitary carriage pivotally mounted to the frame by four bar links forming a four bar linkage which bar links are pivotally mounted by first pivot points to the frame and to second pivot points to the carriage, the unitary carriage mounted for movement between a first position below and spaced from the spool to a second position engaged against the spool;

a knife carriage mounted to the carriage for movement below the spool along a curved path, the movement of the knife carriage defining a leading edge; and a knife mounted to the knife carriage leading edge.

2. The apparatus of claim 1 wherein the knife carriage has a plurality of spring mounted wheels mounted to the knife carriage which engage the reel spool when the knife carriage moves along the curved path.

3. The apparatus of claim 1 further comprising an air blow pipe mounted to the knife carriage, the air blow pipe positioned to blow air against the reel spool so that a web cut by the knife mounted to the knife carriage is held by air passing through the air blow pipe against the reel spool.

4. The apparatus of claim 1 further comprising a first air cylinder mounted between the frame and the carriage to cause the carriage to pivot into engagement with the reel spool.

5. An apparatus for forming and directing a web tail comprising:

a windup stand;

a spool mounted to the windup stand, the spool defining an axis;

a frame mounted upstream of the spool;

a carriage pivotally mounted to the frame for movement between a first position below and spaced from the spool to a second position engaged against the spool;

a knife carriage mounted to the carriage for movement along a curved path, the movement of the knife carriage defining a leading edge; and a knife mounted to the knife carriage leading edge, wherein the knife carriage rides on a pair of tracks which are substantially circumferential with respect to the spool axis when the carriage is engaged against the spool.

6. The apparatus of claim 5 wherein the knife carriage is movable along the pair of tracks by a mechanical linkage connected to a linear actuator.

7. An apparatus for forming and directing a web tail comprising:

a windup stand;

a spool mounted to the windup stand, the spool defining an axis;

a frame mounted upstream of the spool;

a carriage pivotally mounted to the frame for movement between a first position below and spaced from the spool to a second position engaged against the spool;

a knife carriage mounted to the carriage for substantially circumferential movement of the knife carriage with respect to the spool axis when the carriage is in the second position, the movement of the knife carriage defining a leading edge; and a knife mounted to the knife carriage leading edge.

8. An apparatus for directing a web tail comprising:

a windup stand;

a spool mounted to the windup stand, the spool defining an axis;

a frame mounted to a machine floor and mounted upstream of the spool;

a carriage pivotally mounted to the frame for movement between a first position below and spaced from the spool to a second higher position engaged against the spool;

first wheels mounted to the carriage which engage the spool when the carriage is in the second higher position;

a knife carriage mounted to the carriage for movement below the spool along a curved path, the movement of the knife carriage defining a leading edge;

second wheels mounted to the knife carriage, the second wheels being positioned between the first wheels, the second wheels engaging the spool when the carriage is in the second higher position; and a knife mounted to the knife carriage leading edge so that movement of the knife carriage moves the knife circumferentially with respect to an axis of the spool to cut a web tail.

9. The apparatus of claim 8 wherein the carriage is pivotally mounted to the frame by a four bar linkage.

10. An apparatus for directing a web tail comprising:

a frame;

a carriage pivotally mounted to the frame for movement between a first position below and spaced from a spool to a second higher position engaged against the spool;

a knife carriage mounted to the carriage for movement along a curved path, the movement of the knife carriage defining a leading edge; and a knife mounted to the knife carriage leading edge so that movement of the knife carriage moves the knife to cut a web tail, wherein the knife carriage rides on a pair of tracks which are substantially circumferential with respect to an axis of the spool when the carriage is engaged against the spool.

11. The apparatus of claim 10 wherein the knife carriage is movable along the pair of tracks by a mechanical linkage connected to a linear actuator.

12. The apparatus of claim 10 further comprising a pair of wheels mounted to the carriage which engage against the spool.

13. The apparatus of claim 10 wherein the knife carriage has a plurality of spring mounted wheels which hold a web tail against the reel spool.

14. The apparatus of claim 10 further comprising an air blow pipe mounted to the knife carriage, the air blow pipe positioned to blow air against the reel spool so that a web cut by the knife mounted to the knife carriage is held by air passing through the air blow pipe against the reel spool.

15. The apparatus of claim 10 further comprising a first air cylinder mounted between the frame and the carriage to cause the carriage to pivot into engagement with the reel spool.

16. An apparatus for forming and directing a web tail comprising:

a windup stand;

a spool mounted to the windup stand, the spool defining an axis;

a first frame mounted upstream of the windup stand;

a rider roll mounted to a rider roll arm which is pivotally mounted to the first frame, the rider roll positioned above the spool and forming a nip with the spool;

a traversing knife mounted upstream of the rider roll operable to cut a web tail;

a second frame mounted between the first frame and the windup stand and below the rider roll arm;

a carriage pivotally mounted to the second frame for movement between a first position below and spaced from the spool to a second position engaged against the spool;

a knife carriage mounted to the carriage for movement along a curved path, the movement of the knife carnage defining a leading edge; and a knife mounted to the knife carriage leading edge so that movement of the knife carriage moves the knife to cut a web tail.

17. The apparatus of claim 16 further comprising a retractable threading pan mounted above the spool and movable to a position which guides the web tail from the knife, mounted to the knife carriage leading edge, to the nip between the rider roll and the spool.

18. An apparatus for forming and directing a web tail comprising:

a windup stand;

a spool mounted to the windup stand, the spool defining an axis;

a rider roll positioned above the spool and forming a nip with the spool;

a traversing knife mounted upstream of the rider roll operable to cut a web tail;

a frame mounted upstream of the spool;

a carriage pivotally mounted to the frame for movement between a first position below and spaced from the spool to a second position engaged against the spool;

a knife carriage mounted to the carriage for movement along a curved path, the movement of the knife carriage defining a leading edge; and a knife mounted to the knife carriage leading edge so that movement of the knife carriage moves the knife to cut a web tail, wherein the knife carriage rides on a pair of tracks which are substantially circumferential with respect to the spool axis when the carriage is engaged against the spool.

19. A method of turning up a web tail comprising the steps of:

cutting a web to define a first and a second parallel web strip, both running in a machine direction;

directing the first and second parallel web strips over a spool which is rotating at the same speed as the web strips;

from a position beneath the spool moving a carriage into engagement with the spool;

moving a knife carriage along a pair of curved tracks mounted on the carriage, until a knife forming a leading edge of the knife carriage cuts through the first web strip to form a web tail; and blowing the web tail against the spool with air, from an air blow pipe mounted to the knife carriage.

* * * * *